US005662535A

United States Patent [19]

Smith

[11] Patent Number: 5,662,535

[45] Date of Patent: Sep. 2, 1997

[54] GREEN READER DEVICE

[76] Inventor: Glenn E. Smith, 4872 Pacemont Ave., Dayton, Ohio 45415

[21] Appl. No.: 665,086

[22] Filed: Jun. 14, 1996

[51] Int. Cl.[6] ..... A63B 57/00

[52] U.S. Cl. ..... 473/404; 33/385

[58] Field of Search ..... 473/404, 131, 473/407; 33/379, 383, 384, 385, 389, 390, 424–426, 377

[56] References Cited

U.S. PATENT DOCUMENTS

| | | | |
|---|---|---|---|
| 2,692,440 | 10/1954 | Walters | 33/383 |
| 3,293,755 | 12/1966 | Cronwell | 473/404 |
| 3,681,849 | 8/1972 | Venables, III | 33/385 |
| 3,870,299 | 3/1975 | Howe | 473/404 |
| 4,260,151 | 4/1981 | Weaver | 473/404 |
| 5,177,873 | 1/1993 | Tate | 33/385 |
| 5,492,322 | 2/1996 | Smith | 473/404 |

*Primary Examiner*—Steven B. Wong
*Attorney, Agent, or Firm*—Harrison & Egbert

[57] ABSTRACT

A reader device for determining a proper golf ball putt direction relative to a slope of a green including a body, a green viewing area formed in the body, a ball viewing area formed in the body below the green viewing area, a bubble level affixed to the body for indicating a horizontal orientation of the green viewing area, and an indicator adjustably affixed to the body and positioned adjacent to the green viewing area. The indicator serves to indicate a proper putt direction relative to a slope of the green. The green viewing area has an edge in parallel alignment with the bubble level. The indicator is positioned on the body between the ball viewing area and the green viewing area. The indicator includes an indicator member which is pivotally connected to the body and an adjustment mechanism interconnected to the indicator member so as to allow for a pivotting of the indicator member relative to a slope of the green. A series of gears serves to interconnect the indicator member to the adjustment mechanism.

19 Claims, 1 Drawing Sheet

GREEN READER DEVICE

TECHNICAL FIELD

The present invention relates to devices for improving one's golf game. More particularly, the present invention relates to devices for detecting an orientation of a green. More particularly, the present invention relates to devices for facilitating one's understanding of the layout of a golf course.

BACKGROUND ART

The ability to properly determine the orientation of a golf course is important to the improvement of one's golfing game it is important to accurately assess whether a distant target lies at an angle or in a horizontal plane. Adjustments in swing are necessary to accommodate various angular orientations of the putting green. For example, if the putting green extends downwardly from an edge, then it would be desirable to aim the golf ball toward the higher side of the green. This would allow the ball to roll downwardly toward the pin.

Unfortunately, it is often difficult to accurately determine whether the green is in a horizontal plane or if it lies at an angle. The inability to properly determine the orientation of the green can be caused by the poor Judgment of the golfer or by the orientation of the land upon which the golfer is standing. As such, it is desirable to have an independent means for accurately determining the angular planar orientation of the golfing green.

In the past, various devices have been developed so as to facilitate the ability to gain proper judgment on the golf course. Unfortunately, these items are often bulky and difficult to transport. It is very important that any orientation device be small enough to be easily carried, easily used, and easily stowed.

In the past, various patents have issued relating to golfing devices for improving the golfer's assessment of the golf course. For example, U.S. Pat. No. 4,854,579, issued on Aug. 8, 1989, to G. M. Baxter teaches a wind indicator for use by a golfer. This wind indicator includes a vane movably mounted on a base for indicating wind direction. A propeller is rotatably mounted with the vane and carries observable indicia which vary in appearance in accordance with the speed of the propeller and the wind velocity.

U.S. Pat. No. 4,864,854, issued on Sep. 12, 1989, to R. van Leemput describes a golfer's wind indicator and club suggestion assistance device. This device includes a means for indicating wind direction relative to the desired line of flight of the golf ball. A means is also provided for measuring wind velocity and provided with precalibrated indicia awaiting to the measured wind velocity to the number of numerical club designations by which the golfer should increase or decrease the club number which would normally be selected under windless conditions.

U.S. Pat. No. 4,880,232, issued on Nov. 14, 1989, to J. P. Lang teaches a flag pin golf ball distance measuring device that includes an elongated cylindrical pin having a lower end provided with a radially extending flange and dimensioned for registry with a standard golf hole club. A free end of a measuring tape is secured to a sleeve around the elongated cylindrical pin. A cardholder is attached to the pin adjacent the handle and includes a holder for a writing instrument.

U.S. Pat. No. 5,135,220, issued on Aug. 4, 1992, to L. Baldoni describes a golf ball position marker apparatus. A wind indicator vane is mounted hingedly within the housing so as to provide a visual indication of wind direction to assist a golfer in club selection and angle of attack in a golfing game.

U.S. Pat. No. 5,211,400, issued on May 18, 1993, to Hall et al. describes a golf putting aid having a rotatable horizontal sighting ring at the upper end of a vertical support post. A ball/club path marker extends thereacross and outwardly therefrom. A clubhead alignment marker extends transversely across the sight ring to form a cross hair sight at the center of the ring. A smaller ball sight ring approximately the same diameter as a golf ball is disposed within the larger sighting ring at one side of the club head alignment marker. In use, the larger sighting ring is positioned such that when viewed by a golfer in a standing position, the smaller ball sight ring is superposed over the golf ball and the ball/club path marker is aligned with the desired ball path and the club head alignment marker will be perpendicular to the desired golf ball path.

U.S. Pat. No. 5,298,904, issued on Mar. 29, 1994, to K. G. Olich provides a distance measuring system that can be used on a golf course in order for the golfer to accurately measure the distance between the present lie of the golf ball and the hole toward which the golfer is currently advancing the golf ball. This system includes several receivers and transmitters that provide electronic signals for detecting such distances.

The present inventor has filed an earlier patent application for a device related to the present invention which is identified as U.S. application Ser. No. 08/369,368, filed on Jan. 6, 1995, and entitled "Green Reader Device". After extensive demonstration and promotion of the device of this prior application, the inventor has noted that it is often difficult for users to actually use the device so as to improve their putting ability. In particular, it was difficult to determine the proper putt direction once the orientation of the green was determined. This prior device included a generally clear body having a horizontal line and a vertical line formed thereon and a bubble level affixed to the body. The horizontal line and the vertical line extended in an intersecting direction. The bubble level served to indicate a horizontal orientation of the horizontal line. The bubble level was affixed at an edge of the body generally centrally along a top edge of the body. The bubble level was affixed to the body such that the bubble level was in alignment with the top edge of the body. After experiments with this prior invention, it was determined that various improvements were necessary so as to provide a positive indication of the direction of the putt. In other words, a mechanism was necessary so as to facilitate the proper putt direction. As a result of experiments with this prior device, the present invention was developed.

It is an object of the present invention to provide a green reader that assists the golfer in determining the angular orientation of the putt.

It is another object of the present invention to provide a green reader which is accurate despite the angular orientation of the surface upon which the golfer is standing.

It is another object of the present invention to provide a green reader that provides a positive indication of the proper direction of the putting stroke.

It is a further object of the present invention to provide a green reader device which allows the golfer to properly orient the golf ball with the hole for the purposes of determining the proper putting direction relative to the slope of the green.

It is a further object of the present invention to provide a green reader device that is easy to use, easy to manufacture, and relatively inexpensive.

It is another object of the present invention to provide a green reader device that can be easily stowed within the pocket of the golfer.

These and other objects and advantages of the present invention will become apparent from a reading of the attached specification and appended claims.

SUMMARY OF THE INVENTION

The present invention is a reader device for determining a proper golf ball putt direction relative to the slope of a green comprising a body, a green viewing area formed in the body, a bubble level affixed to the body for indicating a horizontal orientation of the green viewing area, a ball viewing area formed in the body below the green viewing area, and an indicator adjustably affixed to the body and positioned adjacent the green viewing area generally above the ball viewing area. The indicator serves to indicate a proper putt direction relative to a slope of the green.

In the preferred embodiment of the present invention, the bubble level is affixed to the body adjacent to a top of the green viewing area. The green viewing area is an opening in the body above the indicator and generally below the bubble level. The green viewing area has an edge in parallel alignment with the bubble level.

The indicator is positioned on the body between the ball viewing area and the green viewing area. The indicator includes an indicator member pivotally connected to the body and an adjustment device interconnected to the indicator member. The adjustment device serves to pivot the indicator member relative to s slope of the green. The adjustment device includes a first gear rotatably mounted to the body and having an edge extending outwardly of the body, a second gear connected to the indicator member such that a rotation of the second gear causes a pivotal movement of the indicator member, and a third gear having a first set of teeth meshing with teeth of the first gear and a second set of teeth meshing with teeth of the second gear. The first set of teeth of the second gear have a greater number of teeth than the second set of teeth. The first set of teeth extend around the third gear with a radius of curvature greater than a radius of curvature of the second set of teeth. The first gear is interconnected to the second gear through the third gear such that a rotation of the first gear causes a relative movement of the second gear. The indicator member is connected to a center of the second gear. The indicator member is generally an arrow having a narrow end adjacent to the horizontal edge of the green viewing area.

DETAILED DESCRIPTION OF THE INVENTION

Figure 1:
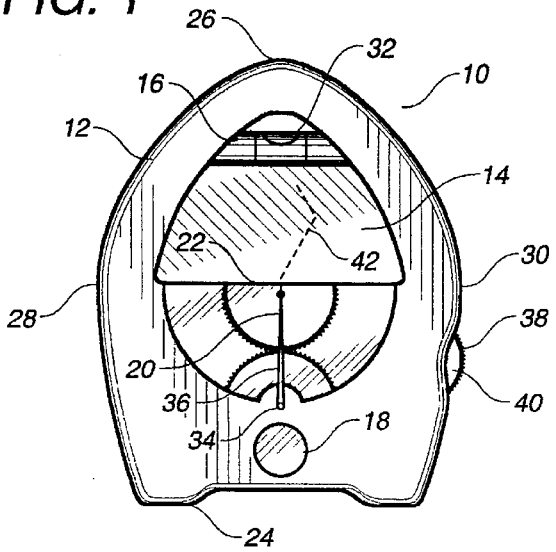
FIG. 1 is a frontal view of the green reader device in accordance with the teachings of the present invention.

Referring to FIG. 1, there is shown at 10 the green reader device in accordance with the teachings of the preferred embodiment of the present invention. The green reader device 10 includes a body 12, a green viewing area 14, a bubble level 16, a ball viewing area 18, and an indicator 20. The green viewing area 14 is formed in the body 12. The bubble level 16 is affixed to the body 12 so as to indicate a horizontal orientation of an edge 22 of the green viewing area 14. The ball viewing area 18 is formed in the body 12 generally below the green viewing area 14. The indicator 20 is adjustably affixed to the body 12 and positioned adjacent to the green viewing area 14. The indicator 20 serves to indicate a proper putt direction relative to a slope of the green.

In FIG. 1, it can be seen that the body 12 is formed of a plastic material having a wide bottom 24 and a generally pointed upper end 26. The sides 28 and 30 of the body 12 initially extend outwardly from the bottom 24 and then taper inwardly toward the pointed upper end 26. The configuration of the body 12, with its upper end 26, provides the golfer with an initial "feel" of the proper orientation of the device 10. The narrow end 26 is generally pointed toward the flag to which the golfer is putting. The body 12 can be formed of a clear or translucent plastic material so as to provide the golfer with proper viewing action while on the putting green.

The green viewing area 14 is an opening in the body 12 generally above the indicator 20 and below the bubble level 16. It is through the green viewing area 14 that the golfer should view the slope of the Green and the desired putting direction to the hole. The bottom edge 22 of the viewing area 14 is generally in parallel alignment with the bubble level 16. In normal use, the edge 22 will have a horizontal orientation when the bubble 32 of the bubble level 16 is centered (as shown in FIG. 1).

The bubble level 16 is affixed to the body 12 generally adjacent to the top of the green viewing area 14. The bubble level 16 is used so as to provide a horizontal orientation of the viewing area 14. The bubble level 16 can be a conventional bubble level which has a bubble 32 formed therein. When the bubble 82 is centered in the bubble level 16, then the golfer can be sure of the proper horizontal orientation of the bottom edge 22 of the green viewing area 14.

The ball viewing area 18 is formed in the body 12 generally below the green viewing area 14. The indicator 20 is positioned on the body 12 between the ball viewing area 18 and the green viewing area 14. The ball viewing area 18 is adjacent to the bottom edge 22 of the body 12 and is positioned generally centrally of the body 12. The ball viewing area 18 will have a vertical axis which is coincident with a pivot point 84 of the indicator 20.

The indicator 20 includes an indicator member 36 which is pivotally connected at pivot point 34 to the body 12. An adjustment mechanism 38 is interconnected to the indicator member 36 so as to pivot the indicator member 36 relative to the slope of the green. As can be seen, the adjustment mechanism 38 includes a first gear 40 which is rotatably mounted in the body 12 and has an edge which extends outwardly of the side 30 of the body 12. In this manner, the Golfer can use his or her thumb to rotate the adjustment mechanism 38 so as to properly manipulate the indicator member 36 about its pivot point 34. As will be described hereinafter, a sequence of gears are used so as to instill the proper motion between the first gear 40 of the adjustment mechanism 38 and the indicator member 36. The indicator member 36 has an arrow-shaped configuration with a Narrow end adjacent to the horizontal edge 22 of the green viewing area 14.

As can be seen in FIG. 1, end as will be described hereinafter in conjunction with FIG. 4, the dotted line 42 is shown in the green viewing area 14 as indicating the proper path of the golf ball toward the hole.

Figure 2:
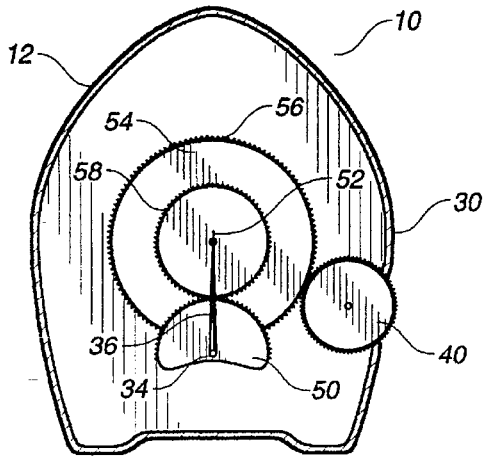
FIG. 2 is a frontal cross-sectional view showing the interaction of components of the green reader device of the present invention.

FIG. 2 shows the adjustment mechanism 38 in the device 10 for the manipulation of the indicator member 36. Initially, it can be seen that a first gear 40 has an outer edge which extends outwardly from the side 30 of the body 12. The edge of the first gear 40 which extends outwardly of the side 30 can be manipulated by the the thumb of the golfer. A second gear 50 is connected to the indicator member 36 at the pivot point 34. As such, as the second gear 50 is rotated, the indicator member 36 will pivot about its pivot point 34 so as to change the orientation of the narrow end 52 of the indicator member 36. The first gear 40 is interconnected to the second gear 50 through a third gear 54. The third gear 54 has a first set of teeth 56 which mesh with the teeth of the first gear 40. The third gear 54 has a second set of teeth 58 which mesh with the teeth of the second gear 50. As can be seen, the second set of teeth 58 has a smaller number of teeth than the first set of teeth 56. Additionally, the first set of teeth 56 extend around the third gear 54 with a radius of curvature greater than a radius of curvature of the second set of teeth 58 around the third gear 54. The first gear 40 is interconnected to the second gear 50 through the third gear 54 such that a rotation of the first gear 40 causes a relative movement of the second gear 50 and a relative movement of the indicator member 36 about its pivot point 34.

It should be noted in FIG. 2 that the third gear 54 is shown as a fully circular gear. However, in such configuration, there is the possibility that the third gear 54 could interfere with the viewing through the green viewing area 14. As such, the third gear can either be a clear gear or it can be a gear segment.

Figure 3:
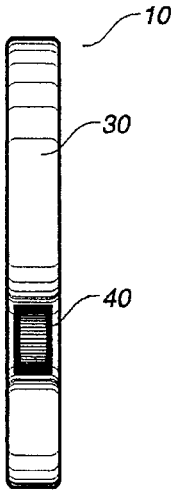
FIG. 3 is a right side view of the green reader device of the present invention.

FIG. 3 is a side view of the device 10. In particular, in FIG. 3, it can be seen that the side 30 has the third gear 40 extending outwardly therefrom. In this position, the golfer can easily manipulate the third gear 40 by simply pushing upwardly or downwardly with the golfer's thumb.

Figure 4:
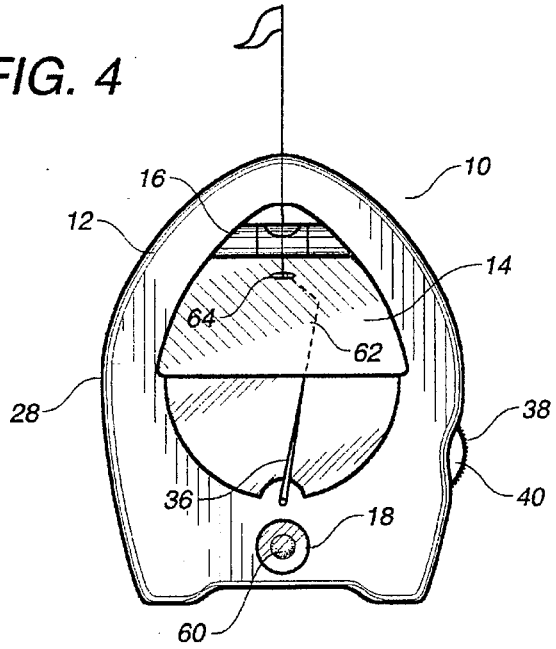
FIG. 4 is a frontal view of the green reader device of the present invention showing the operation of the present invention for the purposes of indicating the putt direction.

FIG. 4 shows the operation of the device 10 for facilitating the ability of the golfer to determine a proper golf ball putt direction relative to a slope of the green. Initially, it is necessary to vertically align the bubble level 16 with the golf ball viewing area 18 while holding the bubble level 16 in a level condition. As can be seen, a golf ball 60 can easily be viewed through the golf ball viewing area 18. Next, the golfer will view through the green viewing area 14 and will adjust the third gear 54 so as to correspond with the actual slope of the green. This movement is accomplished by turning the first gear 40 of the adjustment mechanism 38. As a result, this will automatically align the indicator member 36 so as to show the proper putt line 62. The golfer will receive a positive indication of the proper direction in which to putt so as to accommodate the slope of the green. As can be seen in FIG. 4, the golf hole 64 can be viewed through the green viewing area 14 so as to further facilitate the orientation of the golfer with respect to the slope of the green.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A reader device for a green comprising:

a body;

a green viewing area formed in said body;

bubble level means affixed to said body for indicating a horizontal orientation of said green viewing area; and an indicator means adjustably affixed to said body and positioned adjacent said green viewing area, said indicator means for indicating a proper putt direction relative to a slope of the green.

2. The device of claim 1, said bubble level means affixed to said body adjacent a top of said green viewing area.

3. The device of claim 1, said green viewing area comprising an opening in said body above said indicator means and generally below said bubble level means.

4. The device of claim 3, said green viewing area having an edge in parallel alignment with said bubble level means.

5. The device of claim 1, further comprising:

a ball viewing area formed in said body below said green viewing area.

6. The device of claim 5, said indicator means positioned on said body between said ball viewing area and said green viewing area.

7. The device of claim 1, said indicator means comprising:

an indicator member pivotally connected to said body; and an adjustment means interconnected to said indicator member, said adjustment means for pivotting said indicator member relative to the slope of the green.

8. The device of claim 7, said adjustment means comprising:

a first gear rotatably mounted in said body and having an edge extending outwardly of said body;

a second gear connected to said indicator member such that a rotation of said second gear causes a pivotal movement of said indicator member; and a third gear having a first set of teeth meshing with teeth of said first gear and a second set of teeth meshing with teeth of said second gear.

9. The device of claim 8, said first set of teeth of said second gear having a greater number of teeth than said second set of teeth.

10. The device of claim 9, said first set of teeth extending around said third gear with a radius greater than a radius of said second set of teeth extending around said third gear.

11. The device of claim 8, said first gear interconnected to said second gear through said third gear such that a rotation of said first gear causes a relative movement of said second gear.

12. The device of claim 8, said indicator member being connected to a center of said second gear.

13. The device of claim 7, said indicator member being an arrow having a narrow end adjacent said green viewing area.

14. A reader device for determining a proper golf ball putt direction relative to a slope of a green comprising:

a body;

a green viewing area formed in said body; a ball viewing area formed in said body below said green viewing area;

an indicator means adjustably affixed to said body between said green viewing area and said ball viewing area, said indicator means for indicating the proper putt direction relative to the slope of the green; and a bubble level means affixed to said body for indicating a horizontal orientation of said green viewing area.

15. The device of claim 14, said green viewing area having a horizontal edge generally adjacent said indicator means, said bubble level means positioned in said green viewing area above said horizontal edge.

16. The device of claim 14, said indicator means comprising:

an indicator member pivotally connected to said body; and an adjustment means interconnected to said indicator member, said adjustment means for pivotting said indicator member relative to the slope of the green.

17. The device of claim 16, said indicator member having a point of pivotal connection which is coincident with a vertical axis of said ball viewing area, said indicator member having an end opposite said point of pivotal connection which is adjacent a horizontal edge of said green viewing area.

18. The device of claim 16, said adjustment means comprising:

a first gear rotatably mounted in said body and having an edge extending outwardly of said body;

a second gear connected to said indicator member such that a rotation of said second gear causes a pivotal movement of said indicator member; and a third gear having a first set of teeth meshing with teeth of said first gear and a second set of teeth meshing with teeth of said second gear, said first gear interconnected to said second gear through said third gear such that a rotation of said first gear causes a relative movement of said second gear.

19. The device of claim 18, said indicator member being connected to a center of said second gear.

* * * * *